US005383481A

United States Patent [19]

Waelput

[11] Patent Number: 5,383,481

[45] Date of Patent: Jan. 24, 1995

[54] SYSTEM FOR CLEANING INTERNAL COMBUSTION ENGINES

[75] Inventor: Erik Waelput, 6530 Sattes Dr., Rancho Palos Verdes, Calif. 90274

[73] Assignees: Erik Waelput, Rancho Palos Verdes; Peter Hollub, Sunset Beach; Joseph Lentini, Huntington Beach, all of Calif.

[21] Appl. No.: 969,387

[22] Filed: Oct. 30, 1992

[51] Int. Cl.[6] ..... B08B 9/08

[52] U.S. Cl. ..... 134/56 R; 134/95.1; 134/98.1; 134/103.1; 134/108; 134/111; 134/113; 134/169 A

[58] Field of Search ..... 134/56 R, 57 R, 95.1, 134/98.1, 103.1, 105, 108, 111, 113, 169 R, 169 A; 123/198 A

[56] References Cited

U.S. PATENT DOCUMENTS

| | | | |
|---|---|---|---|
| 1,549,952 | 8/1925 | Anderson | 134/45 X |
| 1,696,100 | 12/1928 | Osborne . | |
| 1,751,053 | 3/1930 | Osborne . | |
| 2,454,585 | 11/1948 | Alderman . | |
| 2,493,120 | 1/1950 | Eaton | 134/21 |
| 2,525,978 | 10/1950 | Vallerie | 134/104.4 X |
| 2,665,772 | 1/1954 | Greer et al. | 134/169 A X |
| 2,896,645 | 7/1959 | Iwasaki | 134/21 |
| 3,029,898 | 4/1962 | Fraser | 134/169 R X |
| 3,431,145 | 3/1969 | Riley | 134/169 A X |
| 3,489,245 | 1/1970 | Broadwell . | |
| 4,140,543 | 2/1979 | Soleri et al. | 134/22 R |
| 4,787,348 | 11/1988 | Taylor | 134/169 A X |
| 4,909,207 | 3/1990 | Takano et al. | 123/198 A |
| 4,964,373 | 10/1990 | Bedi | 123/196 R |
| 4,991,608 | 2/1991 | Schweiger | 134/169 A X |
| 5,063,896 | 11/1991 | Hyatt et al. | 134/169 A X |
| 5,232,513 | 8/1993 | Suratt et al. | 134/21 |

FOREIGN PATENT DOCUMENTS

| | | | |
|---|---|---|---|
| 941932 | 9/1948 | France | 134/169 R |
| 211338 | 2/1967 | Sweden | 134/169 R |

*Primary Examiner*—Philip H. Coe

*Attorney, Agent, or Firm*—Merchant, Gould, Smith, Edell, Welter & Schmidt

[57] ABSTRACT

An apparatus for cleaning internal combustion engines in which a cleaning fluid is cyclically drawn from a reservoir by a pump, flushed through the block of the internal combustion engine, and returned to the reservoir by the pump, is improved by providing it with a pair of cleaning fluid reservoir tanks. Also, tank selection valves alternatively couple one or the other of the reservoir tanks to the pump, to the exclusion of the other tank. In one application of the improved apparatus one tank can be dedicated for use to clean gasoline powered internal combustion engines to preserve the characteristic color of the cleaning fluid, while the other tank can be utilized to clean diesel powered internal combustion engines. In another application the system is operated through first flushing and soaking periods and through second flushing and soaking periods. A first tank in the pair is used to initially pump and recover cleaning fluid during the first flushing and soaking periods. The other tank in the pair is then used to subsequently pump and recover cleaning fluid during the second flushing and soaking periods. The useful life of the cleaning fluid used during the final flushing and soaking periods is thereby prolonged.

25 Claims, 6 Drawing Sheets

GASOLINE COMBUSTION ENGINE

| CYCLE \ VALVE | AIR 124 | INLET 52 | OUTLET 54 | SELECTOR 34 |
|---|---|---|---|---|
| FIRST FLUSH 0–160 SEC | O | C | C | C |
| FIRST FLUSH 160–180 SEC | O | C | O | C |
| FIRST SOAK | C | C | C | C |
| FIRST RECOVERY | O | O | C | C |
| SECOND FLUSH 240–400 SEC | O | C | C | C |
| SECOND FLUSH 400–420 SEC | O | C | O | C |
| SECOND SOAK | C | C | C | C |
| SECOND RECOVERY | O | O | C | C |

FIG. 3

DIESEL COMBUSTION ENGINE

| CYCLE \ VALVE | AIR 124 | INLET 52 | OUTLET 54 | SELECTOR 34 |
|---|---|---|---|---|
| FIRST FLUSH | O | C | C | O |
| FIRST SOAK | C | C | C | O |
| FIRST RECOVERY | O | O | C | O |
| SECOND FLUSH | O | C | C | O |
| SECOND SOAK | C | C | C | O |
| SECOND RECOVERY | O | C | O | O |

FIG. 4

SYSTEM FOR CLEANING INTERNAL COMBUSTION ENGINES

BACKGROUND OF THE INVENTION

1. Field of the Invention

The present invention relates to a method and apparatus for cleaning the internal portions of internal combustion engines, particularly those of automotive vehicles including both gasoline powered and diesel powered vehicles.

2. Description of the Prior Art

It is well know that the operating components of internal engines do collect debris and residue which impairs engine performance. The lubricant which reduces friction in the moving engine parts eventually becomes contaminated with sludge, tar and other chemical contaminants which are produced during the operation of the engine and which are entrained in the lubricant. Also, small particulate of metal do become worn away from the operating parts of the engine and are carried in the lubricant. These small, metal particles can damage engine components that operate at high speeds and temperatures. While regular lubricant changes are absolutely necessary to the continued operation of an internal combustion engine, engine components including valves, seals and other operating members do collect contaminants even if the lubricant is changed frequently. These contaminants reduce engine performance.

Various prior systems have existed for cleaning the interior, operating components of internal combustion engines. These conventional systems typically employ a cleaning fluid which is maintained in a reservoir. The reservoir is connected to a pump. The engine cleaning system is provided with an inlet supply line leading from the pump and connected to one of the crankcase openings with which the internal combustion is equipped.

Virtually all internal combustion engines have an opening which is adapted to receive a removable oil filter cartridge, and an oil pan drain plug opening. When the engine is to be cleaned the oil filter is removed, and the inlet supply line leading from the cleaning fluid pump is typically connected to the oil filter opening. Also the crank case drain plug is removed and a cleaning fluid withdrawal line is connected to the drain plug opening in the crankcase pan. The supply line and withdrawal line are typically supplied with adapters so as to minimize leakage of cleaning fluid entering and leaving the engine block. Once the cleaning fluid has been circulated through the engine block, it is returned by the pump to the reservoir, Typical conventional internal combustion engine cleaning systems of this type are described, for example, in U.S. Pat. Nos. 1,549,952; 2,525,978; 3,431,145; 3,489,245; 4,964,373; and 5,063,896.

In the conventional engine cleaning systems the cleaning liquid employed is flushed through the engine block of an internal combustion engine in a single pass, filtered and returned to the reservoir. By passing the cleaning liquid through filters, the finest of which is a 3 micron filter, harmful particulate matter can be removed from the cleaning liquid, so that the cleaning liquid may be used to clean as many as forty internal combustion engines before requiring replacement.

If the cleaning fluid is utilized to clean gasoline powered internal combustion engines it will largely retain its characteristic color and will only gradually become darker as it is utilized to clean up to a maximum of forty such engines. However, if the cleaning fluid is utilized to clean a diesel powered engine, it will immediately become blackened in color, even though harmful particulate matter has been removed by the filter. This strong discoloration is due to differences in the nature of combustion deposits produced in diesel powered engines as contrasted with those produced in gasoline powered engines. The cleaning fluid is stained black upon first being used to clean a diesel powered internal combustion engine, even if the cleaning fluid has not previously been used to clean any other engine. Thus, although the cleaning fluid may be reused for the balance of its useful life of cleaning up to forty engines, the first time it is utilized to clean a diesel powered combustion engine, it becomes black, and stays black for the rest of its useful life.

This feature presents a problem when the cleaning fluid is utilized to clean a gasoline powered internal combustion engine after having once been used to clean a diesel powered engine. The filter housings through which the cleaning fluid passes as it is withdrawn from the engine are typically transparent, so that the cleaning fluid withdrawn from the engine during cleaning is visible as it returns to a reservoir for recovery, The owners of the vehicles having engines to be cleaning are often curious about the cleaning process and are frequently present and observe the engine cleaning process while it is carried out. The owners of vehicles having gasoline powered engines invariably notice the black color of cleaning fluid which has previously been employed to clean diesel powered internal combustion engines as it is subsequently used to clean their engine. These owners of gasoline powered vehicles assume that such cleaning fluid is so contaminated that it is unsuitable for use in the engines of their vehicles. Consequently, the owners of vehicles employing gasoline driven internal combustion engines often choose not to have their engines cleaned again with cleaning fluid since they become convinced that the cleaning fluid is too dirty to effectively clean their engines.

Another problem with conventional internal combustion engine cleaning systems is that whether or not the cleaning fluid is employed to clean diesel powered engines, it will become discolored somewhat even after it has been used for only a few engine cleanings and still has a very significant portion of its useful life left. Consequently, with the exception of the first few cleanings, the cleaning fluid will always emerge from the internal combustion engine with a certain amount of blackness in color. Automotive owners observing the discolored cleaning fluid being withdrawn from their vehicle engines during the final moments of the cleaning process assume that because the cleaning fluid is still discolored, their engines have not been fully cleaned. They thereupon question the effectiveness and value of the cleaning process. This results in a disinclination to return for subsequent engine cleanings.

SUMMARY OF THE INVENTION

The present invention provides a system in which a portion of the cleaning fluid employed for cleaning internal combustion engines is protected from rapid discoloration. This allows both gasoline powered and diesel powered internal combustion engines to be cleaned utilizing the same equipment while preserving the appearance of the cleaning fluid employed to clean gasoline powered internal combustion engines.

Also, in an alternative utilization of the equipment of the invention, engines can be more thoroughly cleaned while both preserving the color and prolonging the useful life of the cleaning fluid utilized during the final stages of cleaning.

According to one aspect of the present invention, an improvement is provided for an apparatus for cleaning the interiors of internal combustion engines in which a cleaning fluid is cyclically drawn from a reservoir by a pump, flushed through the block of the internal combustion engine, and returned to the reservoir by the pump. The improvement resides in the provision of a pair of cleaning fluid reservoir tanks and tank selection valve means for alternatively coupling one of the cleaning reservoir tanks to the pump to supply cleaning fluid to and receive cleaning fluid therefrom, to the exclusion of the other cleaning fluid reservoir tank.

In another aspect the invention may be considered to be a method of cleaning the interior of an internal combustion engine. According to this method lubricant is withdrawn from the internal combustion engine and a cleaning fluid reservoir is selected from among a pair of cleaning fluid reservoirs. Cleaning fluid is pumped from the selected cleaning fluid reservoir through the internal combustion engine. A first quantity of cleaning fluid is held in the internal combustion engine throughout a first soaking interval and then withdrawn. The first quantity of cleaning fluid is filtered as it is withdrawn to remove contaminant particles therefrom and is recovered. Cleaning fluid is then pumped through the internal combustion engine a second time. A second quantity of cleaning fluid is held in the internal combustion engine throughout a second soaking interval, and then withdrawn from the internal combustion engine. The second quantity of cleaning fluid is filtered to remove contaminant particles therefrom and recovered. Lubricant is then replaced in the internal combustion engine.

In one application of the improved apparatus of the invention the cleaning fluid contained in a first reservoir tank can be dedicated to use in cleaning gasoline powered internal combustion engines, while the cleaning fluid in the second tank can be dedicated to use in cleaning diesel powered internal combustion engines. In this way the appearance of the cleaning fluid employed to clean gasoline powered internal combustion engines is largely preserved, and only gradually becomes discolored through use up to its maximum life of cleaning a total of forty engines. Indeed, even with the final, fortieth use the cleaning fluid dedicated to cleaning gasoline powered internal combustion engines retains more of its characteristic color than cleaning fluid employed to clean a single diesel powered internal combustion engine.

In another application of the improved apparatus of the invention an internal combustion engine is cleaned in two phases. A first of the fluid reservoir tanks is selected by a tank selection means and cleaning fluid is pumped from the tank first selected and flushed through the engine for a first flushing period. The pump is then turned off with a first quantity of cleaning fluid remaining in the engine. This first quantity of cleaning fluid is used to soak the internal parts of the engine to loosen combustion residues for a first soaking period. The first quantity of cleaning fluid is then withdrawn and returned to the reservoir first selected. Even though the cleaning fluid from the tank first selected is filtered before it is returned to the first reservoir, it does acquire some discoloration and not all of the contamination will be removed by the filters in the recycle line.

The second phase of engine cleaning is then commenced by switching the tank selection means to select the second reservoir from the pair of reservoir tanks. A second flushing and a second soaking cycle similar to the first are then performed with cleaning fluid from the second reservoir tank. A second quantity of cleaning fluid from this tank is then returned to the second reservoir selected following the final soaking cycle through filters in the recycle line. Because much of the contamination and residue has already removed from the engine by cleaning fluid from the first reservoir, the cleaning fluid returned to the second reservoir is relatively uncontaminated and relatively undiscolored. Thus, less discoloration is visually apparent as the fluid returns through the filters in the recycle line to the second reservoir that is used for the final flushing and soaking periods.

Because this cleaning fluid is subjected to less contamination, its useful life is prolonged. Moreover, when the cleaning fluid in the second reservoir does finally become somewhat discolored, the tank selection valve means can again be switched so that the partially contaminated cleaning fluid from the second reservoir is then used during the initial flushing and soaking periods. The cleaning fluid in the first reservoir is replaced, and is used only during the final flushing and soaking periods for a number of engine cleanings until it becomes partially contaminated. The system is then switched again to reverse the order of selection of the first and second reservoirs, with the contaminated cleaning fluid in the second reservoir being replaced with fresh cleaning fluid.

The improved apparatus of the invention has double the capacity of a conventional internal combustion engine cleaning apparatus and is capable of cleaning twice the number of engines. If the system is operated so that cleaning fluid from different reservoirs is used to clean gasoline and diesel powered engines, the cleaning fluid in the reservoir dedicated for use with gasoline powered internal combustion engines can clean up to forty such engines. The cleaning fluid dedicated for use with diesel powered internal combustion engines can likewise clean up to forty diesel powered engines. Since the reservoirs are separate, the cleaning fluid within them need not be replaced at the same time. To the contrary, when the cleaning fluid utilized to clean gasoline powered engines has been used to its maximum limit, it is replaced. If the cleaning fluid dedicated for use with diesel powered engines has not yet been utilized to its maximum useful life, it can continue to be used.

The tank selection valve system may be controlled by a simple, manually operable switch which powers solenoids that open passageways to the desired reservoir tank and close passageways to the other tank. The tank selection valve can also be switched automatically between the initial flushing and soaking periods and the final flushing and soaking periods when cleaning fluid from one of the tanks is reserved for use during the final phases of engine cleaning.

The preferred embodiments of the improved apparatus of the invention also have additional desireable features that conventional engine cleaning systems lack. The machine of the invention employs an engine cleaning fluid inlet supply line connected from the pump to the internal combustion engine. A filter, preferably an 18 micron filter is located in the cleaning fluid inlet supply line between the pump and the internal combustion engine. This filter serves to protect a customer's engine and to remove any debris that may be in the cleaning fluid before it reaches the engine. Such debris can become entrained in the cleaning fluid if it escapes entrapment in the filters in the recycle line. This can occur when the debris is large enough to puncture holes in the fine filters in the recycle line and is carried by the return flow into the reservoirs.

Preferably also the system has a rotatable hose reel coupled between the pump and the internal combustion engine. A flexible engine cleaning fluid supply hose and a flexible engine cleaning fluid withdrawal hose are retractably mounted on the hose reel. Each of the hoses has a fixed end that is secured to a radial port in a hollow axle in the hose reel. The hose reel axle is divided internally by a partition, so that cleaning fluid entering from the supply line and cleaning fluid being withdrawn from the engine through the outlet withdrawal line are kept separate.

The inlet supply line and the outlet withdrawal line are connected to their respective ends of the hollow, hose reel axle by axial fittings with sliding seals therein which allow free rotation of the hose reel axle relative to the inlet supply line and outlet withdrawal line, and which prevent leaks at the interfaces thereof with the hollow hose reel axle. The hoses can thereby be compactly stored within a cabinet when the cleaning machine is not in use, and are long enough to be withdrawn from the cabinet and securely coupled to the oil filter opening and the drain plug opening of the internal combustion engine of an automotive vehicle in order to allow circulation of cleaning fluid through the engine.

The cleaning machine of the invention also preferably has a filter strainer, which may be an 80 micron strainer, located in the outlet withdrawal line between the internal combustion engine and the pump. This coarse strainer strains out relatively large, particulate matter which is flushed out of the internal combustion engine by the cleaning fluid and is entrained therein. Particulate matter such as this, for example metal shavings, is often picked up from the internal combustion engine and entrained in the cleaning fluid withdrawn therefrom. Unless large particulate matter such as this is removed before it reaches the pump, it can cause significant damage to the pump.

A further feature of the improved engine cleaning apparatus of the invention is the provision of a pair of filters in the recycle line between the pump and the tank selection valve means which are only slightly different in pore size. Unlike conventional filters which employ paper filter elements, polycarbon filters are employed in the apparatus of the invention. The first recycle line filter located closest to the pump has pore openings of a first particulate size which are larger than the filter openings of a second, downstream particle filter by no more than 5 microns. Preferably, the upstream filter is a 5 micron filter and the downstream filter is a 3 micron filter.

In conventional internal combustion engine cleaning devices a filter having a relatively large pore diameter is located in a cleaning fluid recycle line upstream from a filter having a relatively small pore diameter. For example, in one conventional system a 20 micron filter is employed upstream from a 3 micron filter. As a result, a great many particles of a size between the pore diameters of the two filters are passed by the upstream filter and lodge in the downstream filter. As a consequence, the fine, downstream filter quickly clogs up, thus reducing the rate at which recycled cleaning fluid can be returned to the reservoir tank and reducing the effectiveness of the filter system in the recycle line.

In contrast, in the system of the present invention the upstream filter captures a much larger portion of the particulate matter than is the case with prior systems. The finer, downstream filter thereby does not clog so readily. This increases the rate of throughput of the cleaning fluid and reduces the time required to clean an internal combustion engine. The coarser 5 micron filter is replaced and discarded with each cleaning of a different internal combustion engine.

The invention may be described with greater clarity and particularity by reference to the accompanying drawings.

DESCRIPTION OF THE DRAWINGS

FIG. 3 is a chart showing the condition of the various valves of FIG. 2 during the different phases of a cycle of operation of the machine of FIG. 2 for cleaning an internal combustion engine powered by gasoline with a supply of cleaning fluid dedicated for this purpose.

FIG. 4 is a chart showing the condition of the various valves of FIG. 2 during the different phases of a cycle of operation of the machine of FIG. 2 for cleaning an internal combustion engine powered by diesel fuel with a supply of cleaning fluid dedicated for this purpose.

DESCRIPTION OF THE EMBODIMENT AND IMPLEMENTATION OF THE METHOD

In the step of selecting a reservoir, one fluid cleaning reservoir is selected for cleaning gasoline powered engines and a second, different cleaning fluid reservoir is selected for cleaning diesel powered engines. The first and second quantities of cleaning fluid which are held in the internal combustion engine during the soaking intervals are preferably at least about two gallons in volume.

Figure 1:
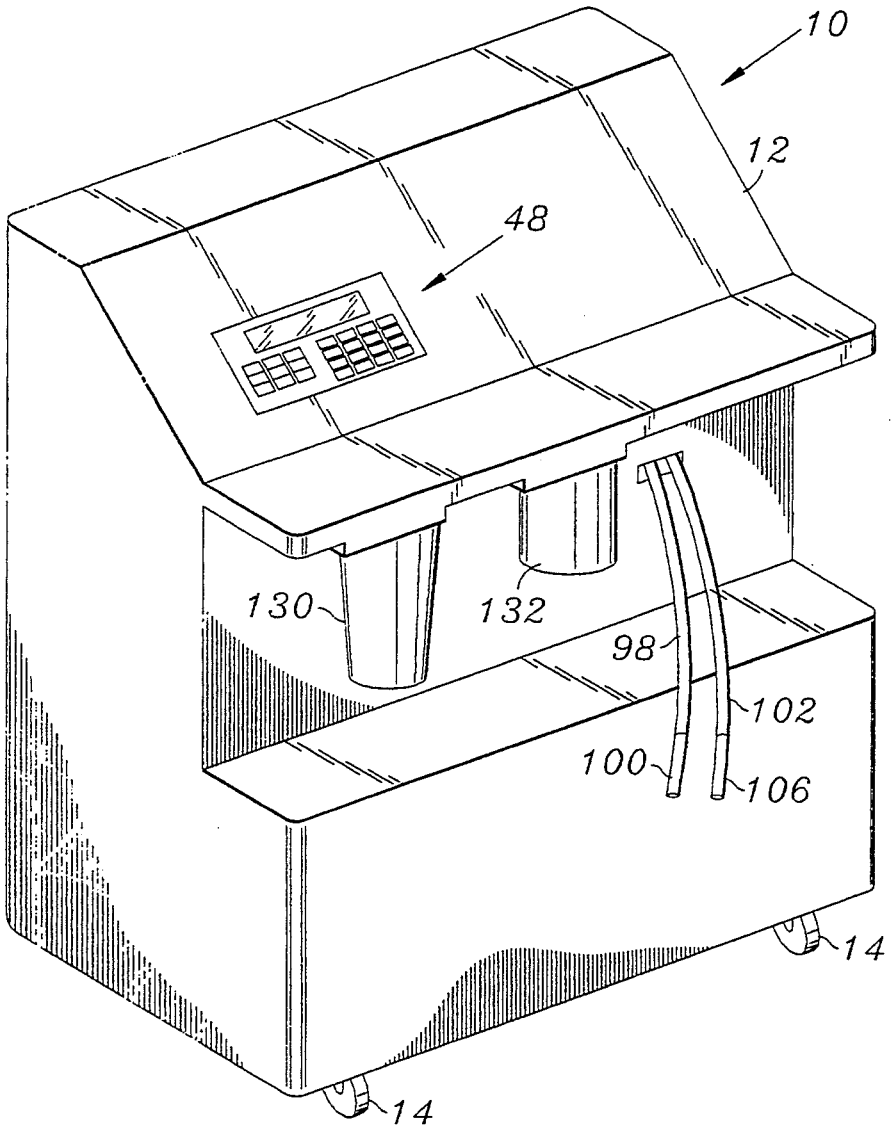
FIG. 1 is an exterior view of the front of a preferred embodiment of the apparatus of the invention.

FIG. 1 illustrates an apparatus indicated generally at 10 for cleaning the interiors of internal combustion engines. The apparatus 10 is formed generally in the shape of a console about four feet in height and having an outer shell indicated generally at 12. The shell 12 is totally removable from an internal chassis which rides on casters, two of which are visible at 14 in FIG. 1. The cleaning machine console can be pushed to the side of an automotive vehicle into close proximity thereto for the purpose of cleaning the interior of the internal combustion engine 16 of the vehicle.

Figure 2:
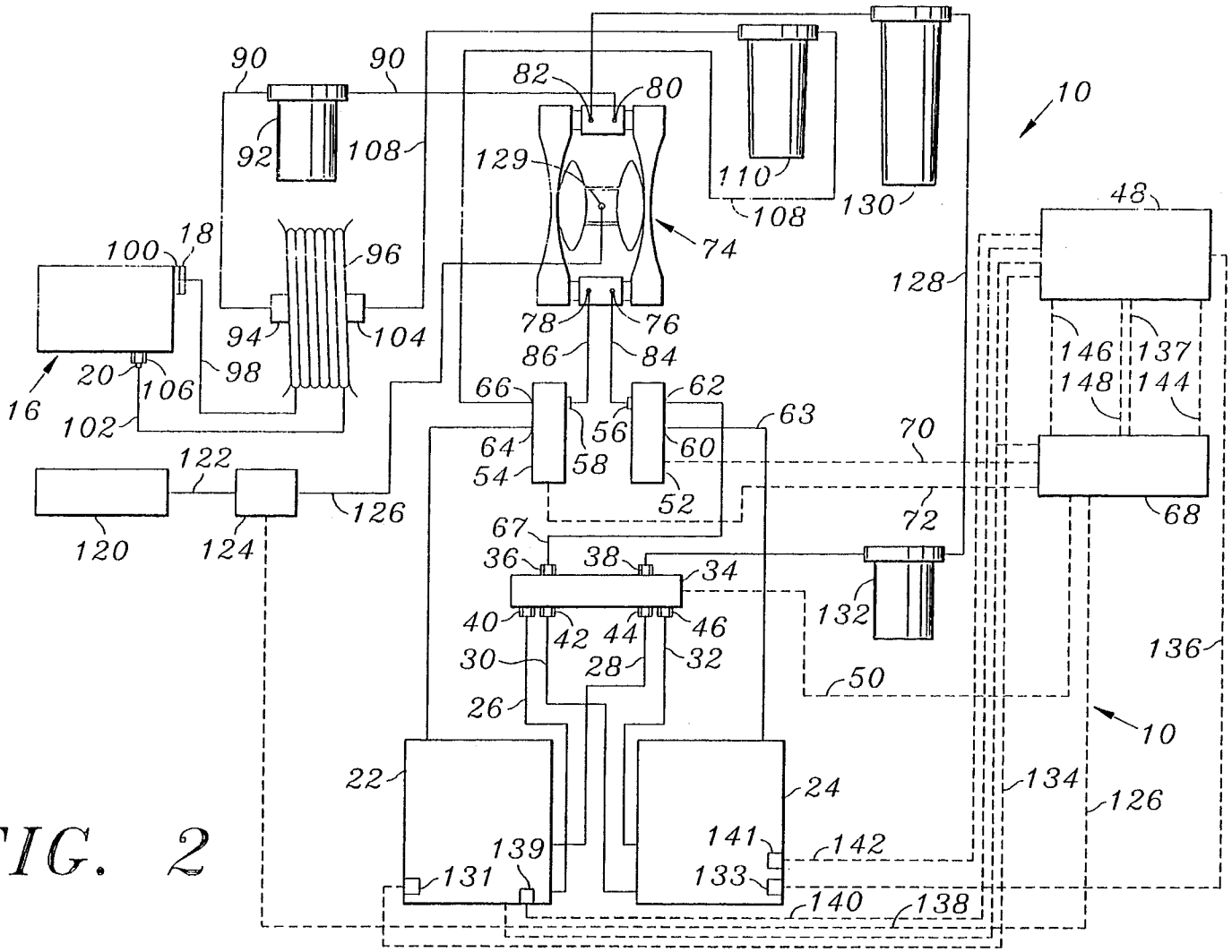
FIG. 2 is a diagrammatic view of the operating components of the engine cleaning machine of FIG. 1.

As shown in FIG. 2 the apparatus 10 is utilized for cleaning the interior of internal combustion engines, one of which is indicated at 16. The internal combustion engine 16 is of conventional design and has an engine block that includes a conventional lubricating oil filter opening 18, which normally is formed by an annular outer ring within which there are various ports or openings to accommodate oil flow. At the center of the oil filter opening 18 there is typically a hollow, externally threaded nipple which forms a central axial duct to accommodate oil flow. The oil filter opening 18 is adapted to receive a removable, replaceable oil filter cartridge which is secured by threaded engagement with the central axial nipple and which forms a liquid tight seal with the outer, annular ring.

The engine 16 also includes a conventional internally threaded oil drain opening 20, usually at the bottom of the oil pan. The oil drain opening 20 accommodates an externally threaded drain plug. The drain plug is normally removed when lubricating oil in the engine 16 is changed.

The operating components of the cleaning apparatus 10 are indicated diagrammatically in FIG. 2. The internal combustion engine cleaning apparatus 10 is designed to be connected to the engine filter coupling opening 18 and the engine drain opening 20 and to cyclically circulate a cleaning fluid through the block of the internal combustion engine 16. The improved cleaning apparatus 10 of the invention is comprised of a pair of cleaning fluid reservoirs. A first reservoir tank is indicated at 22 and a second, separate reservoir tank is depicted at 24. Both of the reservoirs 22 and 24 have a fifteen gallon capacity. Each of the reservoir tanks 22 and 24 contains a twelve gallon volume of liquid cleaning fluid designed to remove residual combustion deposits from the internal passageways and internal operating components of the internal combustion engine 16. The quantities of cleaning fluid are not mixed and are maintained in each of the reservoirs 22 and 24 are maintained isolated and separate from each other throughout operation of the cleaning apparatus 10, regardless of which volume of cleaning fluid is utilized during any phase of the cleaning operation.

The cleaning apparatus 10 employs separate supply and return cleaning fluid conduits connected to each of the cleaning fluid reservoirs 22 and 24. The supply conduit from the reservoir 22 is indicated at 26 and the return conduit for the reservoir 22 is indicated at 28. Similarly, the supply conduit from the reservoir 24 is indicated at 30 while the return conduit for the reservoir 24 is indicated at 32.

The cleaning apparatus 10 also includes a tank selection valve 34. The tank selection valve 34 has an outlet supply port 36 and an inlet return port 38. The outlet supply port 36 is adapted for communication with each of the supply cleaning fluid conduits 26 and 30 for both of the reservoirs 22 and 24 through inlet fittings 40 and 42, respectively. The inlet return port 38 of the tank selection valve 34 is adapted for communication with the return cleaning fluid conduits 28 and 32 by fittings 44 and 46, respectively.

The tank selection valve 34 has an internal gating means for alternatively coupling the cleaning fluid supply and return conduits of each of the cleaning fluid reservoirs 22 and 24, to the exclusion of those of the other, to the outlet supply port 36 and the inlet return port 38, respectively. The tank selection valve 34 may be a spool valve wherein a spool having internal ducts may be shifted longitudinally within a casing to connect the supply and return cleaning fluid conduits of either the first reservoir 22 or the second reservoir 24 through to the supply and return ports 36 and 38. That is, in one position the gating means creates an open flow passageway from the inlet port 40 through to the outlet supply port 36 while the return port 38 has an open flow passageway through the valve 34 leading to the outlet port 44. At the same time, the ports 42 and 46 are blocked.

When the spool of the tank selection valve 34 is shifted longitudinally to the opposite position, the valve ports 40 and 44 are blocked while the valve inlet port 42 is connected through an internal flow passageway to the outlet supply port 36 and at the same time the outlet port 46 is connected through a flow passageway in the valve 34 to the return valve port 38. The tank selection valve 34 is operated under the control of display and operation control unit indicated generally at 48 by means of a cycle controller 68 and a control line 50 that leads to an internal solenoid within the tank selection valve 34.

The cleaning apparatus 10 also includes a fluid inlet selection valve 52 and a separate fluid outlet selection valve 54. Both of the fluid selection valves 52 and 54 may likewise be solenoid operated spool valves, for example. Each of the fluid selection valves 52 and 54 has a single fluid outlet port. The fluid inlet selection valve 52 has a fluid outlet port 56 while the fluid outlet selection valve 54 has a fluid outlet port 58.

The fluid inlet selection valve 52 also has an air inlet port 60 and a cleaning fluid inlet port 62. The air inlet port 60 is connected to the top of reservoir tank 24 by air conduit 63 while cleaning fluid inlet port 62 is connected to outlet supply port 36 of tank selection valve 34 by a cleaning fluid coupling line 67. Similarly, the fluid outlet selection valve 54 has an air inlet port 64 and a cleaning fluid inlet port 66. The air inlet port 64 is connected to the top of reservoir tank 22 by air conduit 65 while cleaning fluid inlet port 66 is connected to an engine outlet cleaning fluid withdrawal line 108.

The fluid selection valves 52 and 54 are each operable to alternatively gate their respective air inlet ports and cleaning fluid inlet ports to their respective fluid outlet ports. That is, the fluid inlet selection valve 52 is operated under the control of a cycle controller indicated generally at 68 by means of a control line 70 to alternatively open a passageway between either the inlet port 60 or the inlet port 62 to the fluid outlet port 56. Similarly, the cycle controller 68 controls the fluid outlet selection valve 54 by means of a control line 72 to alternatively open a passageway from either the air inlet port 64 or the cleaning fluid inlet port 66 to the fluid outlet port 58.

The cleaning apparatus 10 also includes a pump which may be operated by compressed air, although an electronically operated pump could be employed instead. The pump 74 is a double diaphragm pneumatic pump that has first and second suction inlets 76 and 78, respectively and first and second fluid dispensing outlets 80 and 82, respectively. The first suction inlet 76 is connected to the fluid outlet port 56 of the fluid inlet selection valve 52 by means of a coupling conduit 84. The second pump suction inlet 78 is connected to the fluid outlet port 58 of the fluid outlet selection valve 54 by another coupling conduit 86.

A first reservoir air line 65 is connected from the top of the first reservoir tank 22 to the air inlet port 64 of the fluid outlet selection valve 54, while a second reservoir air line 63 is connected from the top of the second reservoir tank 24 to the air inlet port 60 of the fluid inlet selection valve 52.

An engine inlet supply line 90 is connected from the first fluid dispensing outlet 80 of the pump 74 and leads to one of the drain and engine filter coupling openings 18 and 20. In the embodiment depicted the engine cleaning fluid inlet supply line 90 leads to the filter coupling opening 18. An 18 micron filter cartridge 92 is coupled in line in the engine inlet supply line 90 between the first fluid dispensing outlet 80 of the pump 74 and the engine filter coupling opening 18. The filter 92 serves to filter out harmful particles that might be entrained in the liquid cleaning fluid being supplied to the internal combustion engine 16, and which might damage the internal combustion engine 16.

The engine cleaning fluid inlet supply line 90 terminates at the end 94 of a hollow cylindrical axle of a hose reel, indicated generally at 96. The termination of the engine cleaning fluid inlet supply line 90 meets the end 94 of the hose reel axle in a sliding, fluid tight sealing interface, so that the hose reel 96 can freely rotate relative to the engine cleaning fluid inlet supply line 90.

A first inlet supply hose 98 is retractably mounted on the hose reel 96. One end of the engine inlet supply hose 98 is connected in fluid tight engagement with the hose reel axle end 94 at a radial connection thereto to allow passage of cleaning fluid emanating from the engine cleaning fluid inlet supply line 90 to pass from the hollow interior of the axle end 94 into the inlet supply hose 98. The other end of the engine inlet supply hose 98 is releasably secured to the engine filter coupling opening 18 by means of an attachment adapter 100.

An engine outlet withdrawal hose 102 is also retractably mounted on the hose reel 96. One end of the hose 102 is connected by means of a radial, fluid tight coupling to the other axle end 104 of the hose reel axle. The engine outlet withdrawal hose 102 has a second attachment adapter 106 that is releasably secured to the drain coupling opening 20. A fixed, engine outlet cleaning fluid withdrawal line 108 is coupled from the engine outlet withdrawal hose 102 to the cleaning fluid inlet 66 of the fluid outlet selection valve 54. The cleaning fluid outlet withdrawal line 108 leads to the drain coupling opening 20 and is connected thereto through a conventional sliding seal arrangement that exists at the interface of the termination of the cleaning fluid outlet withdrawal line 108 and the second end 104 of the hose reel axle upon which the outlet withdrawal hose 102 is retractably mounted.

An 80 micron filter strainer 110 is mounted in line in the engine cleaning fluid outlet withdrawal line 108. The filter strainer 110 is adapted to trap and prevent the passage of relatively large particles, such as bits of metal, which might be flushed out of the block of the internal combustion engine 16, and which would be likely to damage the pump 74. By positioning the filter strainer 110 in line in the engine cleaning fluid outlet withdrawal line 108, such potentially damaging particles are removed from the cleaning fluid before the cleaning fluid ever reaches the pump 74.

The cleaning machine 10 is also equipped with a shop compressor 120 that supplies compressed air through an air supply hose 122 to an air valve 124. The air valve 124 is connected by means of a conduit 126 to a compressed air inlet port 129 in the pump 74. The compressor 120 is employed to drive the pump 74 to concurrently pump fluid from the first suction inlet 76 to the first fluid dispensing outlet 80 and from the second suction inlet 78 to the second fluid dispensing outlet 82. The air valve 124 is operated under the control of the cycle controller 68 through a control line 126.

The cleaning machine 10 also includes a recycle line 128 that is coupled from the second fluid dispensing outlet 82 of the pump 74 to the inlet return port 38 of the reservoir selection valve 34.

A first, five micron contaminated cleaning fluid filter 130 having a transparent housing is positioned in the recycle line 128, and a second, three micron contaminated cleaning fluid filter 132 also having a transparent housing is located in the recycle line 128 downstream from the first filter 130. It is important for the filters 130 and 132 to have a pore size differential of no more than about five microns. By providing a second downstream filter 132 having a pore size only slightly smaller than that of the upstream filter 130, the downstream filter 132 is less likely to become inordinately clogged, as so often occurs in conventional systems. The larger, upstream five micron filter 130 is replaced at the end of each complete cycle for cleaning an internal combustion engine 16.

The cleaning apparatus 10 also has several other features. Each of the reservoirs 22 and 24 includes a separate heating element and heat sensor unit, indicated diagrammatically at 131 and 133, respectively. The heat element and heat sensor unit 131 for the first reservoir 22 provides a status output on indicator line 134 to the display and operation controller 48. Similarly, the heat control and sensor unit 133 for the second reservoir 24 provides a status output on indicator line 136. The indicator lines 134 and 136 are respectively connected to manually operable heater switches in the display and operation controller 48.

When the operator manually makes a selection using a toggle switch that sends a control signal on line 137 to cycle controller 68 that in turn generates a control signal on line 50 to select either the reservoir tank 22 or the reservoir tank 24, the operator also manually operates a toggle switch associated with the heat control and sensor unit associated with the reservoir selected. Upon actuation of the switch associated with the selected reservoir tank 22 or 24, a control signal is sent to the heat control and sensor unit associated with that selected reservoir heater.

The heat sensor associated with the selected heater provides a signal back to the display and operation controller 48 over the line 134 or 136 once the cleaning fluid within the selected reservoir tank has reached a sufficient temperature. This signal on line 134 or 136 illuminates a light located within the toggle switch associated with that reservoir heater to inform the operator that the cleaning fluid has reached a high enough temperature for use.

Each of the reservoirs 22 and 24 is also equipped with a level sensor, indicated diagrammatically at 139 and 141, respectively. When the cleaning fluid reservoir level sensor 139 for the first reservoir tank 22 indicates that the liquid level of cleaning fluid in the tank 22 is too low, it provides a control signal output on control line 140. If a signal appears on line 140, a signal is generated by the display and operation controller 48 to the cycle controller 68 on line 144. The cycle controller 68 then closes the air valve 124 by a signal on line 126, which shuts off power to the pump 74. This alerts the operator that the reservoir tank 22 is low on cleaning fluid and that the cleaning fluid should be replenished.

A similar level sensor output signal line 142 is connected from a level sensor 141 in the second reservoir 24 to the display and operation controller 48. If the reservoir 24 is selected, and if the cleaning fluid level falls below a lower acceptable limit, a signal output on line 142 is passed to the display and operation controller 48. The display and operation controller 48 then provides a signal to cycle controller 68 on line 144 to shut the unit down. Cycle controller 68 thereupon closes air valve 124 by means of a signal on line 126, which stops operation of the pump 74. Control lines 140 and 142 thereby prevent the reservoirs 22 and 24 from being pumped dry, so as to avoid inadequate cleaning of the engine 16.

Each of the reservoirs 22 and 24 is provided with a separate cycle counter that increments each time the reservoir has been utilized for a complete cycle. The cycle counter for each of the reservoirs 22 and 24 is located in the display and operation controller 48. The cycle counter for the first reservoir 22 is incremented by a signal on line 146 from the cycle controller 68 each time the first reservoir 22 has been selected for use and the pump 74 has been actuated to operate for a complete flush cycle. Similarly, cycle controller 68 increments the counter for the second reservoir tank 24 by a signal on line 148 that is generated each time the second reservoir 24 has been selected for use and the pump 74 has been actuated to operate for a complete flush cycle. The particular counter to be incremented is controlled by a signal on control line 137 from display and operation controller 48, which is transmitted to the cycle controller 68 as well as to the tank selection valve 34.

The cyclical operation of the apparatus 10 in on manner of application may be described with reference to drawing FIGS. 3–6. These drawing figures illustrate operation of the cleaning apparatus 10 when one of the reservoir tanks in the pair of tanks is dedicated for use to clean gasoline powered internal combustion engines and the other reservoir tank is dedicated for use to clean diesel powered internal combustion engines. This mode of operation may be determined by a mode selection switch on display and operation controller 48. FIGS. 3 and 4 are charts illustrating the conditions of the air valve 40, the fluid inlet selection valve 52, the fluid outlet selection valve 54, and the tank selection valve 34. FIG. 3 illustrates the conditions of these valves when the apparatus 10 is employed to clean a gasoline powered internal combustion engine 16, and FIG. 4 illustrates the conditions of the same valves when the apparatus 10 is employed to clean a diesel powered internal combustion engine.

The designation "O" with respect to the air valve 124 indicates that the valve is in an open condition during which there is pneumatic flow of compressed air from the conduit 122 to the conduit 126. In this condition the compressor 120 is coupled to supply compressed air to the pneumatic inlet port 129 so that the pump 74 operates. In the opposite closed condition indicated by "C" the compressor 120 is isolated from the pneumatic inlet port 129, and the pump 74 does not operate.

The designation "C" with respect to the fluid inlet selection valve 52 indicates that the valve 52 has been operated to allow flow from the cleaning fluid coupling line 67 through the cleaning fluid inlet port 62 to the fluid outlet port 56 and on to the coupling conduit 84 leading to the first suction inlet port 76 of the pump 74. The designation "O" with respect to the fluid inlet selection valve 52 means that air is drawn through the line 63 from the top of the reservoir tank 24 through the air inlet port 60 to the fluid outlet port 56 of the inlet selection valve 52. This allows the pump 74 to pump air from the first suction inlet port 76 to the first fluid dispensing port 80.

The indication "C" with respect to the fluid outlet selection valve 54 indicates that there is free flow from the engine cleaning fluid outlet withdrawal line 108 through the outlet valve 54 to the fluid outlet 58 thereof leading to the second suction inlet 78 of the pump 74. In this condition the pump 74 can pump cleaning fluid withdrawn from the engine block of the internal combustion engine 16 through the outlet valve 54 to the recycle line 128.

When the fluid outlet selection valve 54 is in the condition indicated by "O", on the other hand, flow from the engine cleaning fluid outlet withdrawal line 108 is blocked and the pump 74 instead draws air through line 65 and air inlet port 64 of fluid outlet selection valve 54. Air is thereupon pumped through coupling conduit 86 to the second suction inlet port 78 of pump 74 and passed to the second fluid dispensing outlet port 82 thereof. This prevents the pump 74 from trying to pump a vacuum when cleaning fluid should not be pumped through engine cleaning fluid outlet withdrawal line 108. The reason for pumping air from the tops of the reservoirs 22 and 24 rather than just drawing in ambient air is to avoid drawing in particulate matter which is often present in automotive servicing facilities of the type where the equipment is typically utilized.

When the tank selection valve 34 is in the position indicated by "C" the supply line 26 of the first reservoir tank 22 is connected through inlet fitting 40 to the outlet supply port 36 of the tank selection valve 34, while the return conduit 28 is connected through fitting 44 to the inlet return port 38 of the tank selection valve 34. The supply conduit 30 and return conduit 32 of the second reservoir tank 24 are blocked from any communication with the system.

Conversely, when the tank selection valve 34 is in the "O" position the supply conduit 30 of the second reservoir tank 24 is connected through to the supply outlet port 36 and the return conduit 32 is connected through to the return inlet port 38 of the tank selection valve 34. In this condition the supply inlet conduit 26 and return conduit 28 of the first reservoir tank 22 are blocked and there is no flow to or from the first reservoir 22.

To commence operation of the system, lubricant is drained from the engine 16 and the hoses 98 and 102 are first drawn off of the hose reel 96. The adapter 100 is connected to the engine filter coupling opening 18, while the adapter 106 is connected to the engine drain plug opening 20. Operation of the system is then commenced.

Figure 5:
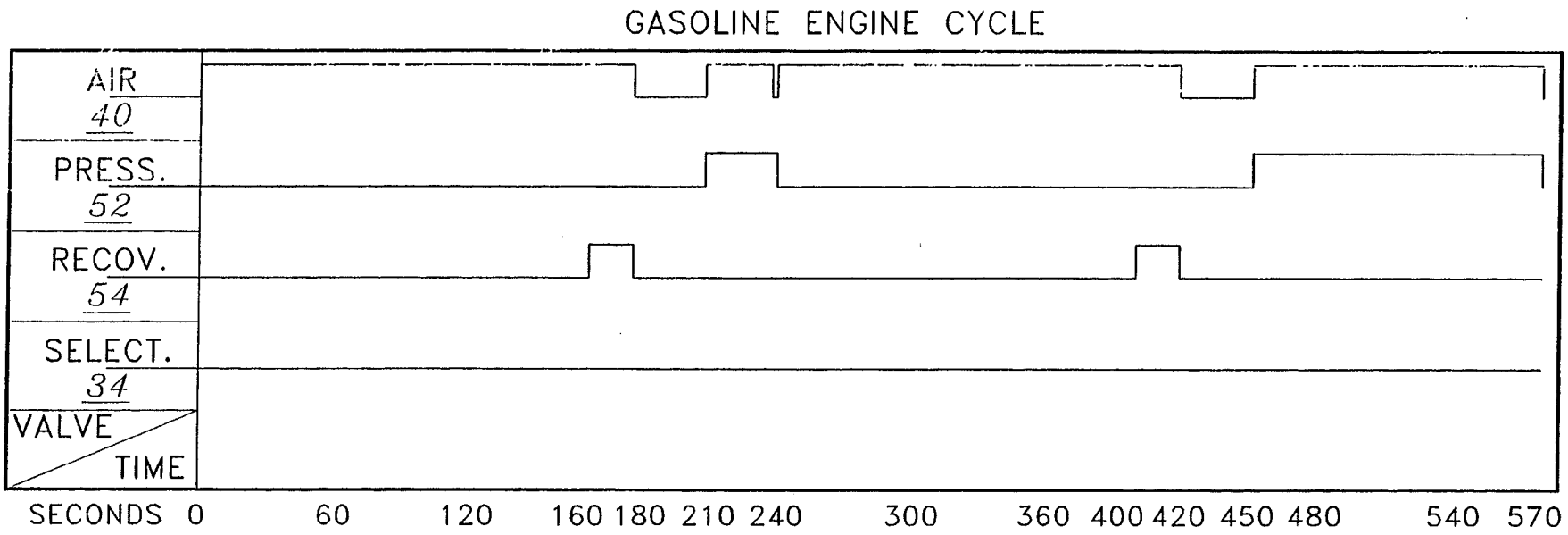
FIG. 5 is a timing diagram showing the operation of the valves according to the chart of FIG. 3.
Figure 6:
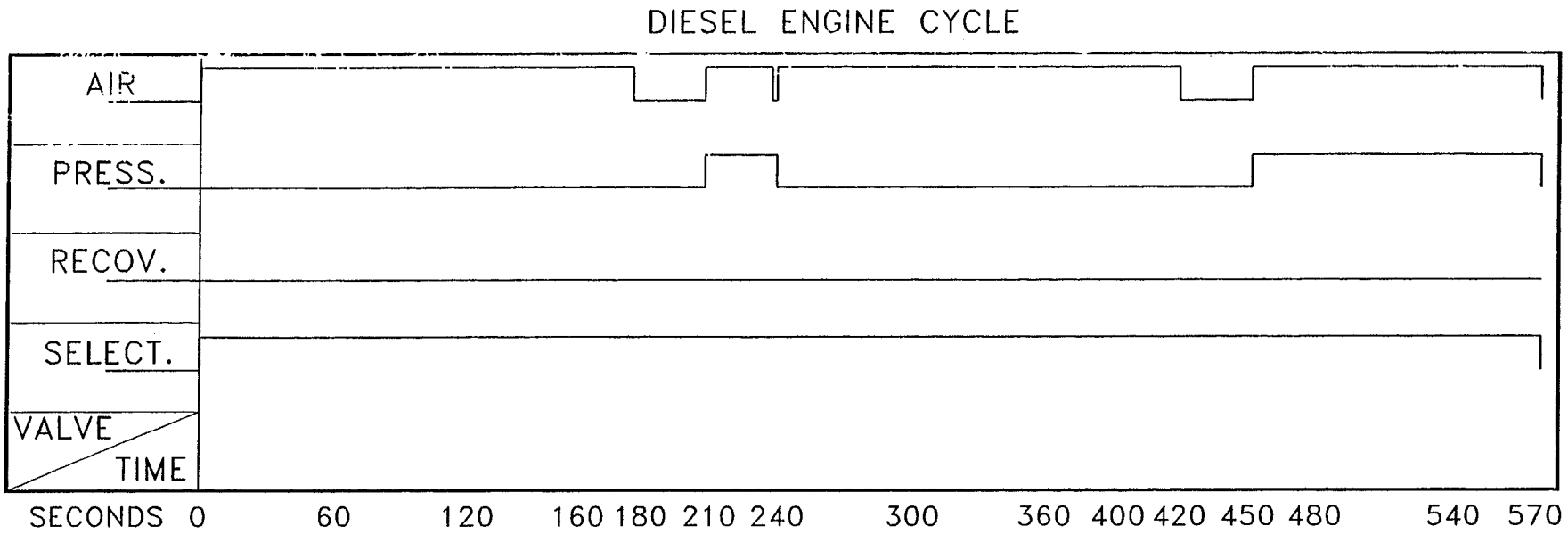
FIG. 6 is a timing diagram showing the operations of the valves according to the chart of FIG. 4.

FIG. 5 illustrates the timing and sequence of operation of the valves 124, 52, 54 and 34 when the apparatus 10 is operated in the mode where one reservoir tank is dedicated for use with either a gasoline powered engine or a diesel powered engine and the selection is made to clean a gasoline powered internal combustion engine. When the cycle of FIG. 5 is actuated by means of a switch on the display and operation controller 48, the air valve 124 opens and stays open for 180 seconds. This commences operation of the pump 74 with the fluid inlet selection valve 52, the fluid outlet selection valve 54 and the tank selection valve 34 all in the closed position. Thus, once the pump 74 commences operation, cleaning fluid is pumped through the supply conduit 26 from the reservoir tank 22, through the connecting conduit 67 to the cleaning fluid inlet 62 of fluid inlet selection valve 52. The cleaning fluid from conduit 67 is pumped through valve 52 and connecting conduit 84 to the first suction inlet 76 of the pump 74. From there, it is pumped through the engine inlet supply line 90, where it passes through the filter 92. Particular matter which would be harmful to the internal combustion engine 16 is removed in the filter 92. The incoming cleaning fluid continues to pass through the engine cleaning fluid input supply line 98 and enters the engine 16 through the engine filter coupling opening 18.

Since the fluid outlet selection valve 54 is in the closed condition, cleaning fluid is flushed through the engine outlet withdrawal hose 102 to the engine cleaning fluid outlet withdrawal line 108, where it passes through the strainer 110. The strainer 110 only removes relatively large particles, such as metal shavings or other matter which might be harmful to the pump 74. The entrained fluid in the outlet withdrawal line 108 still contains entrained engine deposits which have been flushed out of the internal combustion engine 16.

The fluid passes from cleaning fluid inlet port 66 of the fluid outlet selection valve 54 to coupling conduit 86 leading to the second suction inlet 78 of the pump 74. The pump 74 forces the contaminated cleaning fluid through the second fluid dispensing outlet 82 where it enters the recycle line 128. Most of the contaminated material in the fluid in the recycle line is removed by the filters 130 and 132, which remove matter that is three microns or greater in size. From the inlet return port 38 of the tank selection valve 34 the recovered cleaning fluid passes through the return cleaning fluid conduit 28 to the reservoir tank 22.

Throughout most of the first flushing period the internal combustion engine 16 contains about one gallon of recirculating cleaning fluid. When one hundred sixty seconds have elapsed the fluid outlet selection valve 54 opens, thereby blocking cleaning fluid withdrawal line 108 and preventing the further withdrawal of cleaning fluid. This allows the quantity of cleaning fluid in the internal combustion engine 16 to build up to a volume of about two gallons. With the outlet fluid selection valve 54 open, air is drawn through conduit 65 from the upper portion of the reservoir tank 22 and pumped to the second suction inlet 78 of the pump 74, so that a vacuum at the second suction inlet 78 is avoided.

At one hundred eighty seconds into the cycle the fluid outlet selection valve 54 is closed again and the air valve 124 is also closed. This halts operation of the pump 74 for the thirty second interval that the air valve 124 remains closed. During this time, from one hundred eighty to two hundred ten seconds, the two gallon quantity of cleaning fluid is held in the internal combustion engine 16 to soak combustion deposits from the internal operating components of the engine.

At two hundred ten seconds the air valve 40 is again opened and the fluid inlet selection valve 52 is opened to block flow from the cleaning fluid inlet port 62 to the fluid outlet port 56 of the fluid inlet selection valve 52. Instead, air is pumped from the air inlet port 60 through coupling conduit 84 to the first suction inlet 76 of the pump 74. This allows air to be drawn from the upper portion of the reservoir 24 through air conduit 63 to the first suction inlet 76 of the pump 74, thereby preventing a vacuum from occurring at first suction inlet 76.

During the thirty second period between two hundred ten and two hundred forty seconds in the operating cycle that the fluid inlet selection valve 52 is open, cleaning fluid cannot enter the internal combustion engine 16 through the engine filter coupling opening 18, but is withdrawn through the fluid withdrawal line 102 where it passes through the fluid selection outlet valve 54 and travels through the recycle line 128 to return to the reservoir 22. At two hundred forty seconds there is little if any cleaning fluid left in the internal combustion engine 16.

At two hundred forty seconds the inlet fluid selection valve 52 is once again closed. Air valve 124 momentarily closes, but immediately reopens. Since the outlet fluid selection valve 54 remains closed, cleaning fluid can once again circulate fully through the system from supply line 26 through first suction inlet port 76 of the pump 74, through the cleaning fluid inlet supply line 90 and the inlet hose 98. During this period the cleaning fluid is flushed through the internal combustion engine 16 and is returned to the reservoir 22 through the withdrawal hose 102, withdrawal line 108 and recycle line 128.

At four hundred seconds into the cycle the fluid outlet selection valve 54 once again opens, thereby preventing further cleaning fluid from being withdrawn through the engine drain port 20. The volume of cleaning fluid in the engine 16 once again builds up to about two gallons. At four hundred twenty seconds the outlet fluid selection valve 54 again closes and the air valve 124 also closes. This stops operation of the pump 74 to allow the second quantity of cleaning fluid within the internal combustion engine 16 to be held for a second soaking interval while the pump 74 remains dormant.

At four hundred fifty seconds the air valve 124 again opens, thereby reactivating pump 74. The inlet fluid selection valve 52 opens, thereby preventing further cleaning fluid from being withdrawn from the reservoir 22 and passed to the internal combustion engine 16. Since the fluid outlet selection valve 54 remains closed, the cleaning fluid continues to be withdrawn through the withdrawal hose 102, withdrawal line 108 and recycle line 128. The engine is thereupon completely drained of cleaning fluid. This ends the second recovery period and terminates the cleaning cycle. Lubricant is thereafter replaced in the internal combustion engine 16, and the vehicle is again ready for use with the engine in a fully cleaned condition.

The timing and sequencing of the valves 124, 52 and 54 is the same when a diesel powered internal combustion engine 16 is to be cleaned as with a gasoline powered engine, with the exception that the outlet fluid selection valve 54 remains closed throughout the entire cycle of operation. This is because it is unnecessary to build up an additional quantity of cleaning fluid in a diesel powered internal combustion engine 16 during the soaking portions of the cycle. When a diesel powered internal combustion engine 16 is to be cleaned the tank selection valve 34 remains open throughout the entire cycle so that cleaning fluid from the reservoir 24 can be supplied through supply line 30 and outlet supply port 36 and recovered through return line 32 and inlet return port 38 of tank selection valve 34.

The cleaning fluid within the first reservoir 22 remains completely isolated from any contact with either the internal combustion engine 16 or the fluid of the reservoir 24 when a diesel powered internal combustion engine is being cleaned. As a consequence, the cleaning fluid within the first reservoir 22 never comes in contact with either the interior of a diesel powered internal combustion engine, or the cleaning fluid utilized to clean such engines. Consequently, the cleaning fluid in the reservoir 22 retains its characteristic color, and is not blackened by use of the apparatus 10 to clean a diesel powered internal combustion engine, as is the case with conventional engine cleaning devices.

Figure 7:
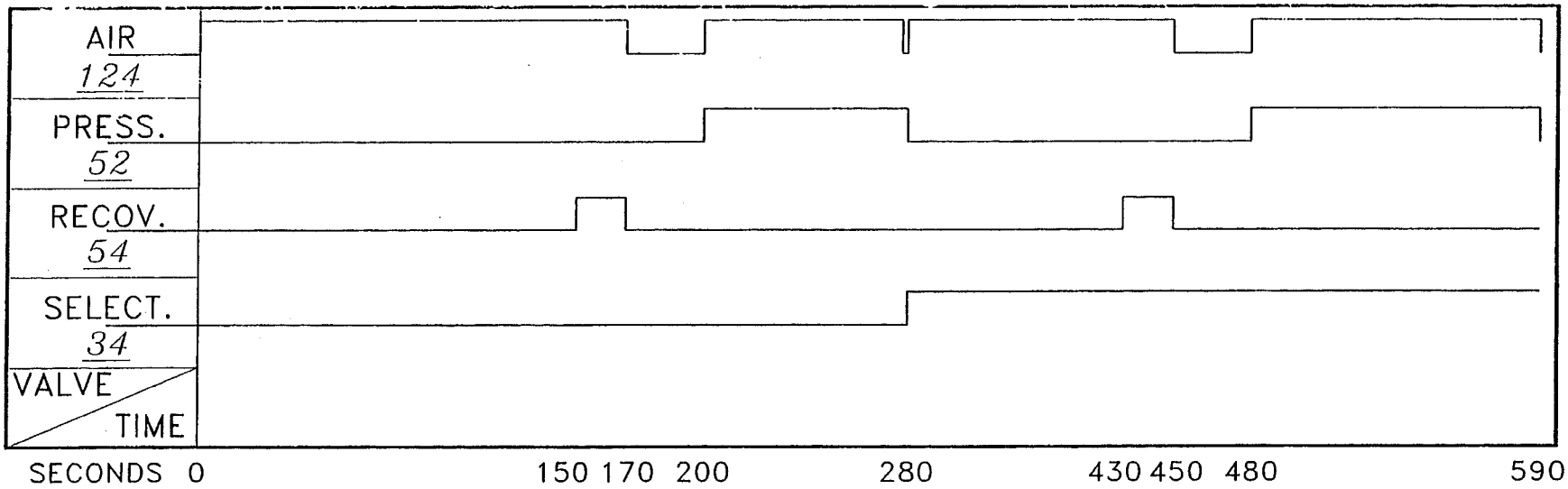
FIG. 7 is a timing diagram showing the operations of the valves when the system is operated so that cleaning fluid from one reservoir is used during the initial phases of engine cleaning while cleaning fluid from the other reservoir is used during the final phases of cleaning an engine.

FIGS. 3 through 6 describe the manner of operation of the engine cleaning apparatus 10 when it is operated in a mode where one of the reservoir tanks is dedicated for use with gasoline powered engines and the other reservoir tank is dedicated for use with diesel powered engines. However, the engine cleaning apparatus 10 may also be operated in a different mode in which one cleaning fluid reservoir is selected from the pair of reservoirs for initially pumping cleaning fluid and recovering a first quantity of cleaning fluid and returning it to the cleaning fluid reservoir initially selected. During the final stages of the cleaning process, however, the other cleaning fluid reservoir in the pair is selected for subsequently pumping cleaning fluid and recovering a second quantity of cleaning fluid by returning it to the other cleaning fluid reservoir. The timing sequence of operations of the air valve 124, the inlet selection valve 52, the outlet selection valve 54 and the tank selection valve 34 are depicted in FIG. 7 for this mode of operation. As shown in FIG. 7, the operator starts the sequence at the display and operation console 48 by generating a signal on line 137 to the cycle controller 68. This causes the cycle controller 68 to generate a control signal on line 126 and, initially, to generate a control signal on line 50 to open the reservoir tank selection valve 34. This causes the cycle controller 146 to generate a signal incrementing the flush cycle counter in the display and operation controller 48 that is associated with the first reservoir 22.

With the pump 74 actuated, cleaning fluid is pumped from the first reservoir 22 through the closed tank selection valve 34 to the fluid outlet port 36 thereof. From there, the cleaning fluid from the first reservoir tank 22 is recirculated through the system in the manner previously described, and is returned to the recycle line 128 through the closed fluid outlet selection valve 54.

At one hundred fifty seconds into this cycle the fluid outlet selection valve 54 opens, thereby preventing contaminated fluid from reaching the recycle line 128. As a consequence, the cleaning fluid level builds up in the internal combustion engine for a period of twenty seconds.

At one hundred seventy seconds the air valve 124 is opened, thereby halting operation of the pump 74. Cleaning fluid no longer recirculates through the internal combustion engine 16. Rather, the first quantity of about two gallons which has accumulated in the internal combustion engine 16 during the twenty second period that the fluid outlet selection valve 54 was opened soaks the internal operating components of the engine 16. This first soaking interval lasts for one hundred seventy seconds to two hundred seconds in the cycle.

At two hundred seconds the air valve 124 is again opened, thereby restarting the pump. The inlet selection valve 34 is also opened while the fluid outlet selection valve 54 remains closed. This causes all of the accumulated cleaning fluid in the internal combustion engine 16 to be withdrawn through the outlet withdrawal line 108.

At two hundred eighty seconds into the cycle the first soaking period terminates with all of the first quantity of cleaning fluid from the reservoir 22 having been withdrawn and returned to that same reservoir. At this time the air valve 124 momentarily closes, but immediately opens again. The inlet selection valve 52 then closes while the outlet fluid selection valve 54 remains in the closed condition. At this same time, however, the tank selection valve 34 is opened, thereby isolating the first reservoir 22 for the remainder of the cycle, and opening the passageway within the tank selection valve 34 that connects the supply conduit 30 to the cleaning fluid outlet port 36 and the return conduit 32 of the second reservoir 24 to the return inlet port 38. Cleaning fluid from the second reservoir 24 is thereupon circulated and recirculated through the internal combustion engine 16 for the second and final flush period from two hundred eighty seconds to four hundred thirty seconds.

At four hundred thirty seconds the outlet selection valve 54 is opened, thereby terminating circulation of cleaning fluid from the reservoir 24 through the system. Since the fluid inlet selection valve 52 is still closed, the pump 74 continues to draw cleaning fluid from the reservoir 24 through the fluid selection valve 52 and pump it into the internal combustion engine 16. The quantity of cleaning fluid in the internal combustion engine 16 builds up to a quantity of approximately two gallons.

At four hundred fifty seconds into the cycle the air valve 124 is closed, whereupon the pump 74 temporarily ceases operation. This commences the second and final soaking period in which cleaning fluid from the second reservoir 24 soaks the internal components of the internal combustion engine 16 for a second soaking interval.

At four hundred eighty seconds the air valve 124 opens and the fluid inlet selection valve 52 also opens. The fluid outlet selection valve 54 remains closed. Thus, cleaning fluid is thereupon withdrawn from the internal combustion engine 16 and passed to the recycle line 128 through the closed fluid outlet selection valve 54. With cleaning fluid being withdrawn from the engine 16, and no cleaning fluid being supplied through the first suction inlet 76 of the pump 74, the internal combustion engine 16 is drained entirely of cleaning fluid by the time of termination of the cycle, which occurs at five hundred ninety five seconds. Cleaning of the engine 16 is thereupon complete, and the lubricant which had been withdrawn prior to commencement to the cleaning operation is replaced.

The engine cleaning apparatus 10 may be operated in this fashion with cleaning fluid from the first reservoir 22 being circulated and used during the first soak period of the cycle, and with cleaning fluid from the second reservoir 24 being used during the second and final flush and soak periods. It is evident that the cleaning fluid in the first reservoir 22 will become far more contaminated with far fewer engine cleanings that the fluid in the second reservoir 24.

Since the fluid in the second reservoir 24 remains in a relatively uncontaminated condition, the appearance of that cleaning fluid more properly reflects the fact that the engine has, indeed been cleaned.

After about forty engine cleanings the cleaning fluid in the first reservoir 22 is replaced and the condition of the tank selection valve 34 is reversed. That is, fluid from the second reservoir 24 is initially employed during the initial flush an soak periods, while the fresh cleaning fluid in reservoir 22 is reserved for use during the second and final flush and soak periods.

Undoubtedly, numerous variations and modifications of the invention will become apparent to those familiar with internal combustion engine cleaning equipment and procedures. Accordingly, the scope of the invention should not be construed as limited to the specific embodiment depicted and implementation of the method described herein.

I claim:

1. Apparatus for cleaning the interiors of internal combustion engines each having a drain opening and an engine filter coupling opening for receiving removable lubrication filters comprising:

separate first and second cleaning fluid reservoirs, separate supply and return cleaning fluid conduits connected to each of said fluid reservoirs, reservoir selection valve means having an outlet supply port and an inlet return port adapted for fluid communication with said separate supply and return cleaning fluid conduits for both of said reservoirs and having gating means for alternatively coupling said cleaning fluid supply and return conduits of each of said cleaning fluid reservoirs, to the exclusion of those of the other, to said outlet supply port and said inlet return port respectively, a fluid inlet selection valve and a separate fluid outlet selection valve each having a single fluid outlet port, an air inlet port and a cleaning fluid inlet port, whereby each fluid selection valve is operable to alternatively gate its air inlet port and its cleaning fluid inlet port to its fluid outlet port, pump means having a first suction inlet connection to said fluid outlet port of said fluid inlet selection valve, a second suction inlet connected to said fluid outlet port of said fluid outlet selection valve, a first fluid dispensing outlet and a second fluid dispensing outlet, first and second reservoir air lines connected from the tops of said first and second reservoirs to separate ones of said air inlet ports of said fluid inlet and fluid outlet selection valves, an engine cleaning fluid inlet supply line connected from said first fluid dispensing outlet of said pump means and leading to one of said drain and engine filter coupling openings, an engine cleaning fluid outlet withdrawal line connected from said cleaning fluid inlet of said fluid outlet valve and leading to the other of said drain and engine filter coupling openings, and a recycle line coupled from said second fluid dispensing outlet of said pump means to said inlet return port of said reservoir selection valve means.

2. Apparatus according to claim 1 further comprising a hose reel coupled to said engine inlet supply line and an engine inlet supply hose retractably mounted on said hose reel and having a first attachment adapter releasably secured to said one of said drain and engine filter coupling openings.

3. Apparatus according to claim 2 further comprising an engine outlet withdrawal hose retractably mounted on said hose reel and connected to said engine cleaning fluid withdrawal line and having a second attachment adapter releasably secured to said other of said drain and engine filter coupling openings.

4. Apparatus according to claim 1 further comprising an inlet filter connected between said first fluid dispensing outlet of said pump means and said one of said drain and engine filter coupling openings.

5. Apparatus according to claim 1 further comprising a strainer connected between said other of said drain and engine filter coupling openings and said cleaning fluid inlet of said fluid outlet selection valve.

6. Apparatus according to claim 1 further comprising a first contaminated cleaning fluid filter having a pore size of no greater than ten microns located in said recycle line and a second contaminated cleaning fluid filter having a pore size differential no less than five microns from that of said first contaminated cleaning fluid filter located in said recycle line downstream from said first contaminated cleaning fluid filter.

7. Apparatus according to claim 6 wherein said first contaminated cleaning fluid filter has a pore size of about five microns and said second contaminated cleaning fluid filter has a pore size of about three microns.

8. Apparatus according to claim 1 further comprising an operator control panel, a heating element and a temperature sensor in each of said reservoirs, temperature signal lines connecting each of said temperature sensors to said operator control panel, and temperature indicator means on said operator control panel connected to said temperature signal line to provide a visual signal once a minimum threshold cleaning fluid operating temperature has been reached.

9. Apparatus according to claim 1 further comprising an operator control panel, level sensor means in each of said reservoirs, level signal lines connecting said level sensor means to said operator control panel, separate level indicating means in said operator control panel connected to each of said level signal lines, and a control override line connected from said level signal lines to said pump, whereby said level sensor means actuate an associated level indicating means and disable said pump by a signal on said control override line when cleaning fluid level in a reservoir selected by said reservoir selection valve means falls below a predetermined minimum allowable level.

10. Apparatus according to claim 1 further comprising an operator control panel, flush initiation means on said operator control panel coupled to said pump to actuate said pump to operate for a flushing cycle, separate resettable counters on said operator control panel for each of said cleaning fluid reservoirs, and counter incrementing means coupled to said reservoir selection valve means and to said flush initiation means to increment each of said resettable counters when the reservoir associated therewith is selected by said valve selection means and said pump is also actuated to operate for a flushing cycle.

11. Apparatus for cleaning a lubrication system of an internal combustion engine having an oil drain opening and an oil filter opening, the apparatus comprising means for connecting an inlet of the apparatus with the oil drain opening, means for connecting an outlet from the apparatus to the oil filter opening, a first reservoir tank for a first cleaning fluid, a second reservoir tank for a second cleaning fluid, a pump for flushing cleaning fluid to the oil filter opening through a lubrication system of an internal combustion engine and for returning the cleaning fluid from a lubrication system of the engine through the oil drain opening, tank selection valve means, control means for the valve means for alternatively coupling one of the cleaning fluid reservoir tanks through the valve means to the pump to supply cleaning fluid from the first reservoir tank to the oil filter opening and to feed and to receive back from the drain opening in the first reservoir tank substantially all the supplied cleaning fluid while the second reservoir tank is isolated by the valve means from the pump, and wherein in a first cleaning mode the first reservoir tank only is used in a first cleaning cycle and in a second cleaning cycle, and wherein in a second cleaning mode, the first reservoir and the second reservoir are both used such that in the second cleaning mode there is a first cleaning cycle wherein the first reservoir tank is used and in a second cleaning cycle of the second cleaning mode the second reservoir is used.

12. Apparatus for cleaning a lubrication system of an internal combustion engine having an oil drain opening and an oil filter opening, the apparatus comprising means for connecting an inlet of the apparatus with the oil drain opening, means for connecting an outlet from the apparatus to the oil filter opening, a first reservoir tank for a first cleaning fluid, a second reservoir tank for a second cleaning fluid, a pump for flushing cleaning fluid to the oil filter opening through a lubrication system of an internal combustion engine and for returning the cleaning fluid from a lubrication system of the engine through the oil drain opening, tank selection valve means, control means for the valve means for alternatively coupling one of the cleaning fluid reservoir tanks through the valve means to the pump to supply cleaning fluid from the first reservoir tank to the oil filter opening and to receive back from the drain opening in the first reservoir tank substantially all the supplied cleaning fluid while the second reservoir tank is isolated by the valve means from the pump, and the control means being operable to perform at least two cleaning cycles and wherein the control means controls the valve whereby the first reservoir is dedicated to the first cleaning cycle and the second reservoir is dedicated to a second cleaning cycle and including means for effecting such dedications for at least a predetermined number of overall engine cleanings, and wherein in a first cleaning mode the first reservoir tank only is used and wherein in a second cleaning mode, the first reservoir and the second reservoir are both used such that in the second cleaning mode there is a first cleaning cycle wherein the first reservoir tank is used and in a second cleaning cycle of the second cleaning mode the second reservoir is used.

13. Apparatus as claimed in claim 12 wherein after a predetermined number of overall engine cleanings the control means permits the second reservoir tank to be used for the first cleaning cycle, and the first reservoir tank to be used for the second cleaning cycle.

14. Apparatus for cleaning a lubrication system of an internal combustion engine having an oil drain opening and an oil filter opening, the apparatus comprising means for connecting an inlet of the apparatus with the oil drain opening, means for connecting an outlet from the apparatus to the oil filter opening, a first reservoir tank for a first cleaning fluid, a second reservoir tank for a second cleaning fluid, a pump for flushing cleaning fluid to the oil filter opening, through a lubrication system of an internal combustion engine, and for returning the cleaning fluid from a lubrication system of the engine through the oil drain opening, tank selection valve means, control means for the valve means for alternatively coupling one of the cleaning fluid reservoir tanks through the valve means to the pump to supply cleaning fluid from the first reservoir tank to the oil filter opening and to receive back from the drain opening in the first reservoir tank substantially all the supplied cleaning fluid while the second reservoir tank is isolated by the valve means from the pump, and wherein when a lubrication system being cleaned is a diesel engine the first reservoir tank only is used for a first cleaning cycle and a second cleaning cycle, and wherein when a lubrication system being cleaned is a gasoline engine, the first reservoir and the second reservoir are both used, such that a first cleaning cycle for a gasoline engine uses the first reservoir tank and in a second cleaning cycle the second reservoir is used.

15. Apparatus as claimed in claim 14 wherein after a predetermined number of overall cleaning cycles, the control means permits the reservoir used for the second cycle of cleaning gasoline engines to be used for cleaning diesel engines.

16. An apparatus according to claim 11 wherein the outlet from the apparatus comprises an engine cleaning fluid inlet supply line connected from said pump to the oil filter opening of said internal combustion engine, and an inlet filter located in said engine cleaning fluid inlet supply line.

17. Apparatus according to claim 11 further comprising a rotatable hose reel coupled between said pump and said internal combustion engine, and wherein the outlet from the apparatus includes a flexible engine cleaning fluid supply hose retractably mounted on the reel.

18. Apparatus according to claim 17 wherein the inlet to the apparatus further comprises a flexible engine cleaning fluid withdrawal hose retractably mounted on the reel.

19. Apparatus according to claim 18 further comprising an engine cleaning fluid outlet withdrawal line connected between said engine cleaning fluid withdrawal hose and said pump, and a strainer located in said engine cleaning fluid outlet withdrawal line.

20. Apparatus according to claim 11 further comprising an engine fluid recycle line coupled between said pump and said tank selection valve means, a first recycle line filter located in said engine fluid recycle line and having a filter opening of a first particle size, a second recycle line filter located in said engine fluid recycle line downstream from said first recycle line filter and having filter openings of a second particle size that is smaller than said first particle size, and said particle sizes of said recycle line filters differ from each other by no more than five microns.

21. An apparatus according to claim 12 wherein the outlet from the apparatus comprises an engine cleaning fluid inlet supply line connected from said pump to the oil filter opening of said internal combustion engine, and an inlet filter located in said engine cleaning fluid inlet supply line.

22. Apparatus according to claim 12 further comprising a rotatable hose reel coupled between said pump and said internal combustion engine, and wherein the outlet from the apparatus includes a flexible engine cleaning fluid supply hose retractably mounted on the reel.

23. Apparatus according to claim 22 wherein the inlet to the apparatus further comprises a flexible engine cleaning fluid withdrawal hose retractably mounted on the reel.

24. Apparatus according to claim 23 further comprising an engine cleaning fluid outlet withdrawal line connected between said engine cleaning fluid withdrawal hose and said pump, and a strainer located in said engine cleaning fluid outlet withdrawal line.

25. Apparatus according to claim 22 further comprising an engine fluid recycle line coupled between said pump and said tank selection valve means, a first recycle line filter located in said engine fluid recycle line and having a filter opening of a first particle size, a second recycle line filter located in said engine fluid recycle line downstream from said first recycle line filter and having filter openings of a second particle size that is smaller than said first particle size, and said particle sizes of said recycle line filters differ from each other by no more than five microns.

* * * * *